US011192180B2

(12) United States Patent
Schacher

(10) Patent No.: US 11,192,180 B2
(45) Date of Patent: Dec. 7, 2021

(54) SLIDING GATE FOR A VESSEL CONTAINING MOLTEN METAL

(71) Applicant: Refractory Intellectual Property GmbH & Co. KG, Vienna (AT)

(72) Inventor: Damian Schacher, Inwil (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 0 days.

(21) Appl. No.: 16/616,799

(22) PCT Filed: Jun. 1, 2018

(86) PCT No.: PCT/EP2018/064453
§ 371 (c)(1),
(2) Date: Nov. 25, 2019

(87) PCT Pub. No.: WO2019/007597
PCT Pub. Date: Jan. 10, 2019

(65) Prior Publication Data

US 2020/0282456 A1 Sep. 10, 2020

(30) Foreign Application Priority Data

Jul. 5, 2017 (EP) ..... 17179692

(51) Int. Cl.
*B22D 41/38* (2006.01)

(52) U.S. Cl.
CPC ..... *B22D 41/38* (2013.01)

(58) Field of Classification Search
CPC ..... B22D 41/38; B22D 41/22
See application file for complete search history.

(56) References Cited

U.S. PATENT DOCUMENTS 4,042,207 A 8/1977 Nehrlich et al.
4,596,345 A 6/1986 Beckers
6,045,015 A 4/2000 Waltenspuhl et al.
(Continued)

FOREIGN PATENT DOCUMENTS

WO 2019007597 A1 1/2019

OTHER PUBLICATIONS

B. Steiner et al., Automationsloesungen fuer Pfannenschrieberanwendungen, Stahl und Eisen, Verlah Stahleisen, Dusseldorf, Germany, vol. 128, No. 11, Nov. 12, 2008, pp. 99-112 (cited in International Search Report).

*Primary Examiner* — Scott R Kastler
(74) *Attorney, Agent, or Firm* — Brian Roffe

(57) ABSTRACT

Sliding gate for a vessel containing molten metal includes a slide housing, a slide unit guided longitudinally in the slide housing and having a push rod, a mounting and a linear drive removably fastened in the latter and has a drive rod. This drive rod can be connected to the push rod by a coupling. The coupling is designed such that, when the linear drive has been pushed into the mounting, it automatically couples by movement of the drive rod towards the slide unit, while it uncouples when the linear drive is removed from the mounting transversely in relation to the direction of movement of the drive rod. A locking device is actuated by the linear drive and interacts with the mounting, by means of which the linear drive after being pushed into the mounting is fixed in the latter and can be unlocked again before it is removed.

20 Claims, 3 Drawing Sheets

(56) References Cited

U.S. PATENT DOCUMENTS

| | | | | |
|---|---|---|---|---|
| 8,371,484 | B2 * | 2/2013 | Keller | B22D 41/38<br>222/600 |
| 2012/0037831 | A1 | 2/2012 | Boisdequin et al. | |
| 2018/0029117 | A1 | 2/2018 | Renggli | |
| 2020/0282456 | A1 * | 9/2020 | Schacher | B22D 41/22 |

* cited by examiner

SLIDING GATE FOR A VESSEL CONTAINING MOLTEN METAL

FIELD OF THE INVENTION

The invention relates to a slide closure for a vessel containing a molten metal, that includes a slide housing, a slide unit longitudinally guided therein, a push rod, a holder on the slide housing, a linear actuator removably fixed in the holder, a drive rod connectable to the push rod of the slide unit by a coupling designed such that it couples in the linear actuator pushed into the holder by displacing the drive rod against the slide unit, and wherein the coupling has a coupling part at the end on the push rod and a coupling part at the front end of the drive rod of the linear actuator which couple when displacing the drive rod.

BACKGROUND OF THE INVENTION

A slide closure of the type in question is disclosed in document EP 0 875 320 B1, which closure serves to regulate the discharge from the vessel during casting, by this vessel being restricted open, closed or controlled, by displacing the slide unit by means of a linear actuator via the openings of the closure plates braced in fire-resistant manner against one another. Therefore, firstly the push rod of the slide unit must be coupled to the drive rod of the linear actuator. This takes place independently with the help of the linear actuator by the drive rod thereof being displaced against the push rod of the slide unit. After casting, the linear actuator is usually pulled out of the holder receiving it, and remains on the casting platform, while the empty vessel is brought to a pan position or the like for maintenance. For simplified assembly, the linear actuator is pushed into the holder laterally in a guide groove by the latter, in which it is held largely in form-locking manner during the casting process.

OBJECTS AND SUMMARY OF THE INVENTION

The object of the invention is to improve a slide closure of the type named at the outset such that automated installation or removal of its linear actuator before and after casting is made possible.

This object is achieved, according to the invention, by providing a locking device which can be actuated by a linear actuator and interacts with a holder, and through which the linear actuator can be fixed after being pushed into the holder or can be unlocked again before removing the same.

With this design, it is possible to position the linear actuator precisely, with the locking device actuated by same, and fix it during casting without impairing the further functions of the linear actuator, specifically the independent coupling to the slide unit and the displacement of same to regulate the discharge out of the casting vessel.

Within the scope of a design which is as simple as possible, it is provided, according to the invention, that the linear actuator is formed by a hydraulic cylinder which is provided with a main piston driving the drive rod and an additional piston, which can be moved independently of this, for actuating the locking device.

In this way, it is possible to lock or unlock the linear actuator to or from the slide unit of the slide closure before coupling to same, prior to the coupling being released at the front end of the drive rod.

In a preferred embodiment, the invention provides that the additional piston is provided with a locking head guided on the drive rod, which head withdraws when the additional piston is loaded in locking direction at the front from the inside of the hydraulic cylinder and penetrates in positive- or friction-locking manner into a correspondingly formed recess in the holder, while the cylinder is removed from the recess and travels back inside the hydraulic cylinder when the additional piston is loaded in unlocking direction.

Within the scope of as simple a control of the linear actuator as possible, it is also expedient if the locking of the hydraulic cylinder, the coupling of its drive rod to the push rod of the slide unit and the actuation of same during the casting process is carried out in centrally controlled manner by a preferably programmable control unit.

A particularly suitable linear actuator according to the invention is characterized in that it is designed to be multifunctional, by managing the locking of the linear actuator in its holder, the coupling of its drive rod to the push rod of the slide unit and the displacement of the slide unit during the casting process for controlling the quantity of discharge of the molten metal from the vessel.

In so doing, within the scope of the most compact design possible, it is advantageous to design the hydraulic cylinder such that its inside is divided, by the main piston and the additional piston, into three chambers which can be pressure-loaded independently of one another, wherein the hydraulic cylinder is unlocked when the central chamber is loaded and the drive rod is coupled, when the rear chamber facing away from this drive rod is loaded, to the push rod of the slide unit or, when the central chamber is loaded, is displaced to regulate the casting process, while the hydraulic cylinder is unlocked while the front chamber is loaded.

Moreover, it is expedient to design the hydraulic cylinder such that, between both pistons, it is provided with a separating wall serving as stop for the additional piston, with an opening allowing free passage of the drive rod.

BRIEF DESCRIPTION OF THE DRAWINGS

The invention is explained in more detail below using an embodiment example, with reference to the drawings. These show, in.

DETAILED DESCRIPTION OF THE INVENTION

Figure 1:
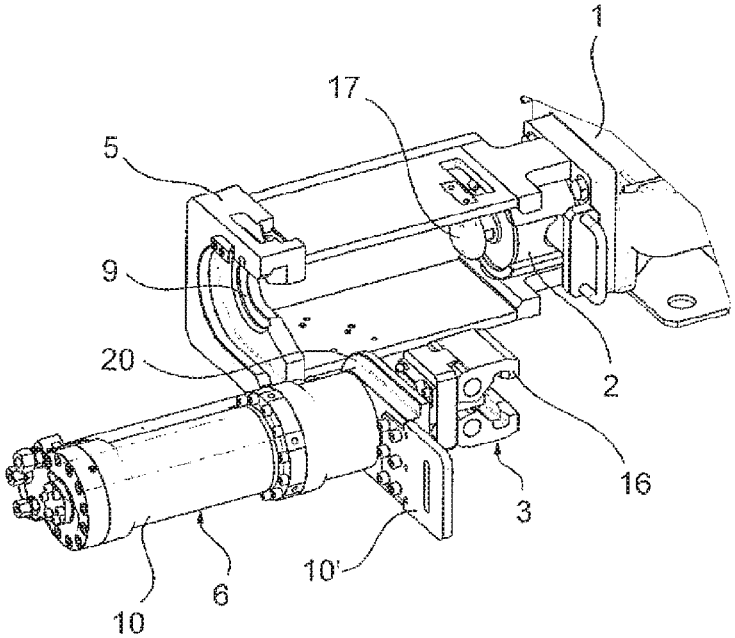
FIG. 1 is a perspective view of a holder of a slide closure with a linear actuator shown before assembly.
Figure 2:
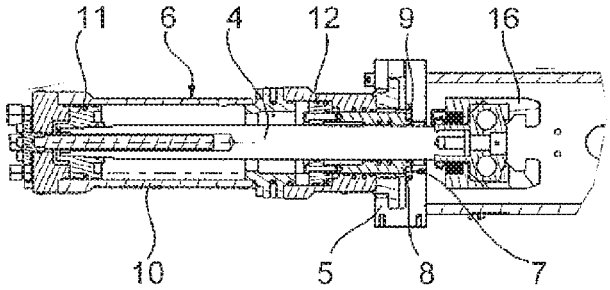
FIG. 2 is a longitudinal section of the linear actuator according to FIG. 1 in locked state with the holder.
Figure 3:
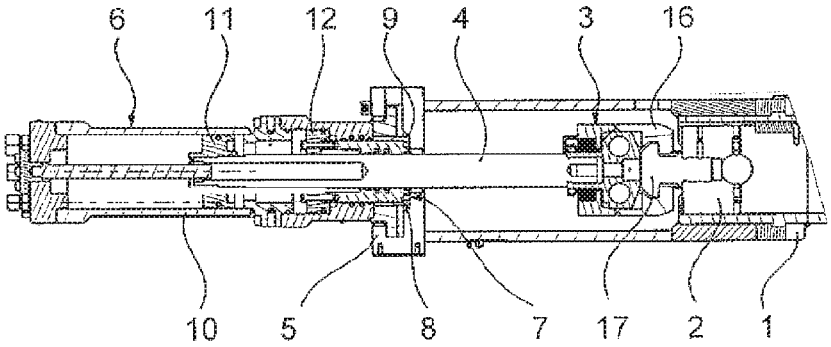
FIG. 3 shows the linear actuator according to FIG. 1 in locked and coupled state with a push rod of the illustrated slide closure, likewise shown in longitudinal section.

FIG. 1 to FIG. 3 show a holder 5 of a slide housing 1 as well as a linear actuator 6 for a slide closure which can be received in same, which actuator has the slide housing 1 as well as a slide unit longitudinally guided therein via a push rod 2.

The configuration and the manner of operating such a slide closure as well as the holder and the coupling is explained in detail in the document EP 0 875 320 B1 recognized at the outset, and therefore not all its details are displayed below.

The linear actuator 6 is usually mounted initially in the holder of the slide closure, after the vessel provided in particular as a pan is placed on the casting platform of a strand casting system filled with molten metal. This takes place advantageously with a robot manipulator not shown in more detail, which manipulator can be coupled to a coupling piece 10' of the linear actuator 6, and in so doing, pushes the linear actuator 6 laterally, with its flange 20, into a recess of the holder 5.

In order to ensure that the linear actuator 6 remains immovably fixed in the holder 5 during operation, according to the invention, the slide closure is equipped with a locking device 7 which can be actuated with the linear actuator 6 and interacts with the holder 5.

With this locking device 7, after pushing the linear actuator 6 into the holder 5, advantageously a secure fixing of same is achieved with the robot manipulator, or when removing the linear actuator, this is released again whereby, after being pushed into the holder, the linear actuator can be fixed in same, or can be unlocked again before removal from same. This locking device 7 has a preferably cylindrical locking head 8 which, when locked, is pushed, in form-locking manner, into a likewise cylindrical recess 9 of the holder 5. On the other hand, this locking head 8 can be removed from the recess 9 when the additional piston 12 of the locking device 7 is loaded.

Figure 4A:
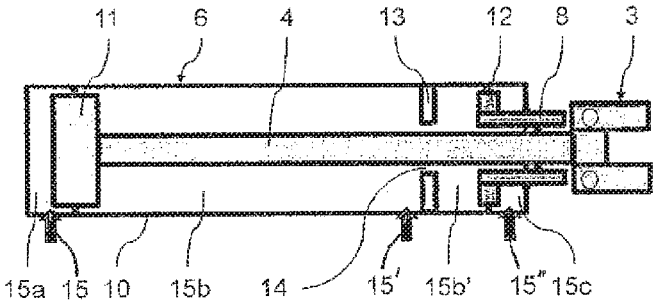
FIG. 4*a* to FIG. 4*f* show the linear actuator, in different operating positions, shown schematically in longitudinal section.

The linear actuator 6 operating according to the invention comprises a hydraulic cylinder 10 with two pistons 11 and 12 which can be moved independently of one another, wherein the main piston 11 serves to actuate the drive rod 4, while the additional piston 12 is used to actuate the locking device 7. As can be seen in particular from FIG. 4*a*, the locking head 8 is guided tightly onto the drive rod 4 and can be displaced relative to same by the additional piston 12. A separating wall 13, serving as a stop for the additional piston 12, is arranged between the two pistons 11 and 12 in the hydraulic cylinder 10, which wall is provided with a central opening 14 through which the drive rod 4 penetrates.

In so doing, this push rod 2 can be connected to the drive rod 4 of the linear actuator 6 via a coupling 3, wherein, by displacing the drive rod 4 of the linear actuator against the push rod 2 of the slide unit, the coupling 3 couples independently. Said coupling is provided with a coupling part at the end on the push rod 2 and a coupling part at the front end of the drive rod 4 of the linear actuator 6 which couple when displacing the drive rod 4, and in the meantime this coupling 3 uncouples independently when removing the linear actuator 6 from the holder 5 transverse to the displacement direction of the drive rod 4.

The coupling 3, which works automatically, is designed as a claw coupling, the spring-loaded elements 16 of which are spread outwards when displacing the drive rod 4 via the coupling head 17 of the push rod 2, until they snap due to elastic force and enclose the coupling head 17 of the push rod 2 in form-locking manner, as shown in FIG. 3. The likewise independent uncoupling takes place by removing the linear actuator 6 laterally, by the two claw elements 16 sliding, when snapped, transverse to the longitudinal extension of the push rod 2 on the coupling head 17 until they are released laterally by same.

The way the linear actuator 6 works is illustrated in FIG. 4*a* to FIG. 4*f*. The inside of the hydraulic cylinder 10 is divided by the two pistons 11 and 12 into three chambers 15*a*, 15*b* and 15*c*, which can be loaded independently, the inlets into which are indicated with corresponding arrows 15, 15', 15", which are white when the chambers are loaded and black when the chambers are not loaded. The central opening 14 in the separating wall 13 makes possible the free passage of a medium from the chamber 15*b* into this chamber 15*b*' between this separating wall 13 and the piston 12.

Figure 4B:
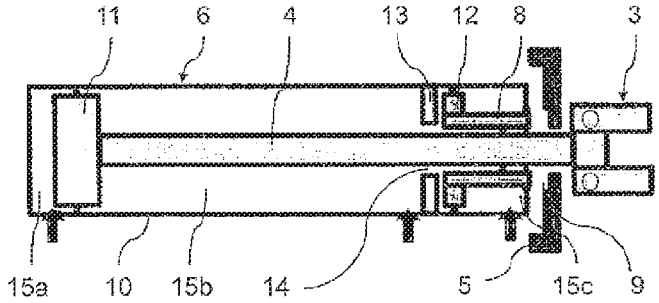

FIG. 4*b* shows the hydraulic cylinder 10 upon installation in the holder 5 of the housing with piston 12 and locking head 8 retracted.

Figure 4C:
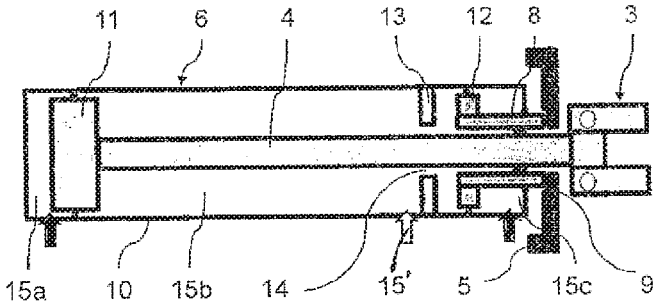
Figure 4C:
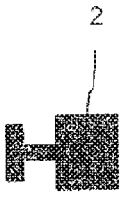
Figure 4D:
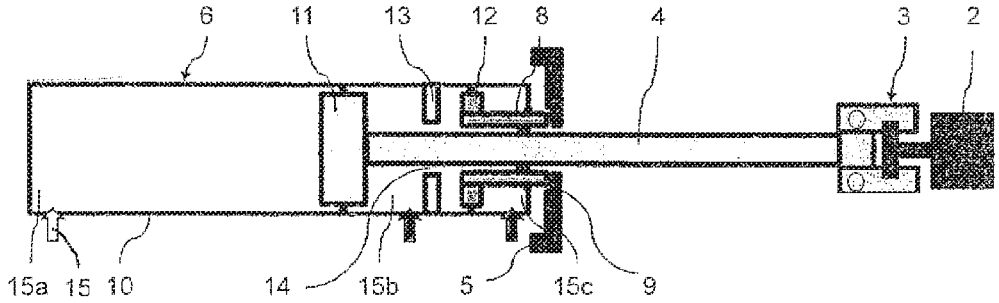

According to FIG. 4*c*, when the central chamber 15*b* is loaded, the hydraulic cylinder 10 is locked to the holder 5 and when the rear chamber 15*a*, which faces away from this drive rod 4, is loaded, the drive rod is coupled to the push rod 2 of the slide unit (FIG. 4*d*). As can be seen in FIG. 4*c*, the loaded chamber 15*b* is illustrated by white arrow 15' or the other two black arrows 15, 15" when the chambers 15*a*, 15*c* are not loaded.

Figure 4E:
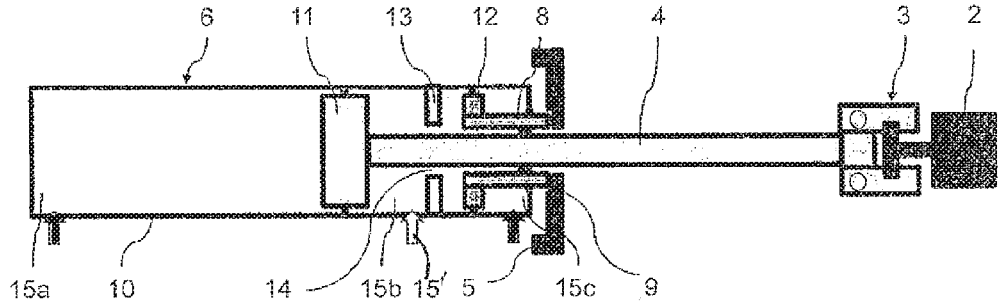

When the chambers 15*a* or 15*b* are loaded, during casting, the slide unit is operated and thus an opening or closing or a restriction of the slide closure is brought about (FIG. 4*d* or FIG. 4*e*). This is illustrated in each case by the white arrow 15 or 15'. Such a pressure is maintained in the chamber 15*b* that the locking head 8 is pressed always into the recess 9 of the holder 5.

Generally, the locking head 8 could be pressed into the recess 9 of the holder 5 such that a force lock would be achieved between this and the holder 5.

Figure 4F:
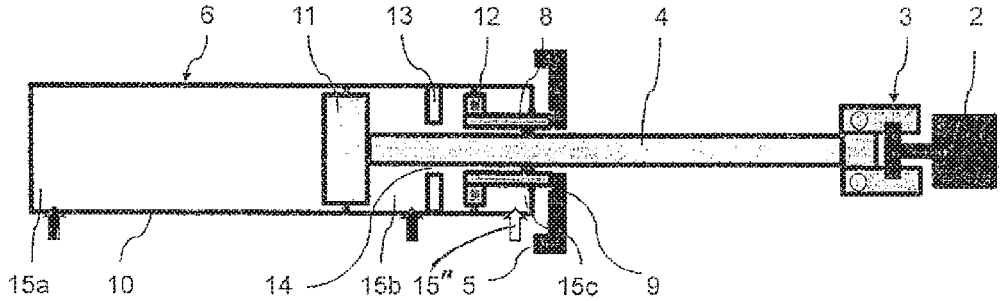

FIG. 4*f* shows the unlocking of the locking head 8 in which the front chamber 15*c* in the hydraulic cylinder 10 is loaded with the media pressure, as shown by white arrow 15". Once this unlocking has taken place, the linear actuator 6 can be pulled out laterally, with the coupling 3 being released independently.

As an alternative variant to the above explained embodiment example, in the linear actuator 6, this central opening 14, through which the drive rod 4 penetrates, could be sealed. Then, an additional inlet would lead into the separate chamber 15*b*', by means of which the piston 12 and with it the locking head 8 could be pushed forward into the recess 9 of the holder 5.

The locking device 7 according to the invention is suitable both for so-called two-part slide plates with one fixed and one mobile slide plate and also so-called three-part slide plates with two fixed slide plates and a slide plate displaceable between same.

Generally, the coupling could be provided vice versa with the claw elements on the push rod of the slide unit, while the other coupling part could be provided with the flange-type development of the drive rod of the linear actuator.

The invention claimed is:

1. A slide closure, comprising:

a slide housing attachable to a vessel adapted to contain molten metal;

a push rod of a slide unit guided in a longitudinal direction in said slide housing;

a holder coupled to said slide housing and including a recess having an opening on a lateral side;

a linear actuator comprising a movable drive rod and a first piston, said linear actuator being insertable into and removable from said holder transversely relative to the longitudinal direction through the opening of said recess and being actuatable, when in said holder, to vary a distance between said drive rod and said push rod;

a coupling assembly for coupling said drive rod to said push rod when said linear actuator is in said holder; and a locking device comprising a locking head coupled to said first piston, said locking head being insertable into engagement with and removable from engagement with said recess upon movement of said first piston.

2. The slide closure of claim 1, wherein said recess has a shape corresponding to said locking head such that said locking head penetrates into said recess upon movement of said first piston in a direction toward said recess.

3. The slide closure of claim 1, wherein said linear actuator further comprises a flange that engages with said holder when said linear actuator is in said holder.

4. The slide closure of claim 1, wherein said linear actuator further comprises a hydraulic cylinder, and a second, main piston that drives said drive rod through an interior of said hydraulic cylinder, said first piston being movable independent of said second, main piston and actuating said locking device by displacing said locking head.

5. The slide closure of claim 4, wherein said locking head is configured to be withdrawn when said first piston is loaded in a locking direction at a front from an inside of said hydraulic cylinder and said hydraulic cylinder is removable from said recess when said first piston is loaded in an unlocking direction.

6. The slide closure of claim 4, wherein said hydraulic cylinder has an interior having first, second and third chambers, said first chamber being between said second, main piston and a first axial end of said hydraulic cylinder, said second chamber being between said second, main piston and said first piston, and said first piston being situated in said third chamber, said second chamber being between said first and third chambers, said first, second and third chambers being loadable independent of one another, said drive rod passing through said second and third chambers and a second axial end of said hydraulic cylinder opposite said first axial end of said hydraulic cylinder.

7. The slide closure of claim 6, wherein said hydraulic cylinder is unlocked when said second chamber is loaded.

8. The slide closure of claim 6, wherein said drive rod is coupleable, when said first chamber is loaded, to said push rod.

9. The slide closure of claim 6, wherein said drive rod is displaceable when said second or third chamber is loaded.

10. The slide closure of claim 6, wherein said hydraulic cylinder is unlockable when said third chamber is loaded.

11. The slide closure of claim 6, wherein said hydraulic cylinder further comprises a separating wall between said second and third chambers such that said separating wall is between said first piston and said second, main piston, said separating wall being a stop for movement of said first piston in a direction away from said second axial end of said hydraulic cylinder, said separating wall having an opening through which said drive rod passes, said opening being dimensioned relative to said drive rod to allow passage of a medium from said second chamber into a space between said separating wall and said first piston.

12. The slide closure of claim 1, wherein said locking head is guided on said drive rod.

13. The slide closure of claim 1, wherein said coupling assembly, when said linear actuator is in said holder, couples said drive rod to said push rod by displacing said drive rod toward said slide unit.

14. The slide closure of claim 1, wherein said coupling assembly comprises a first coupling part on said push rod and a second coupling part on said drive rod which couple when said second coupling part on said drive rod engages with said first coupling part on said push rod.

15. The slide closure of claim 1, wherein said locking head is insertable in a positive-locking or friction-locking manner into said recess.

16. The slide closure of claim 1, wherein said coupling assembly is situated in said holder.

17. The slide closure of claim 1, wherein locking of said hydraulic cylinder, coupling of said drive rod to said push rod and actuating of said slide unit are controlled by a control unit.

18. The slide closure of claim 1, wherein said linear actuator is removably fixed in said holder.

19. The slide closure of claim 1, wherein said linear actuator is removable from engagement with said holder after independent decoupling of said drive rod from said push rod.

20. An apparatus connected to a slide housing attachable to a vessel adapted to contain molten metal, the slide housing including a slide unit having a push rod guided in a longitudinal direction in the slide housing, the apparatus comprising:

a holder coupled to the slide housing and including a recess having an opening on a lateral side;

a linear actuator comprising a movable drive rod and a first piston, said linear actuator being insertable into and removable from said holder transversely relative to the longitudinal direction through the opening of said recess and being actuatable, when in said holder, to move said drive rod outward from said linear actuator;

a coupling assembly that enables said drive rod to couple to the push rod when said linear actuator is in said holder and said drive rod is moved outward from said linear actuator through said holder; and a locking device comprising a locking head coupled to said first piston, said locking head being insertable into engagement with and removable from engagement with said recess upon movement of said first piston.

* * * * *